United States Patent [19]

Ciarcia et al.

[11] 4,166,988

[45] Sep. 4, 1979

[54] COMPACT THREE-POLE CIRCUIT BREAKER

[75] Inventors: Ronald D. Ciarcia, Plantsville; Raymond K. Seymour, Plainville, both of Conn.

[73] Assignee: General Electric Company, New York, N.Y.

[21] Appl. No.: 897,896

[22] Filed: Apr. 19, 1978

[51] Int. Cl.[2] ..... H01H 73/06; H01H 71/02

[52] U.S. Cl. ..... 335/9; 200/50 C; 337/50

[58] Field of Search ..... 335/8, 9, 10; 337/47, 337/48, 49, 50; 200/50 C

[56] References Cited

U.S. PATENT DOCUMENTS

| | | | |
|---|---|---|---|
| 3,069,517 | 12/1962 | Cole | 335/9 |
| 3,353,127 | 11/1967 | Francis et al. | 335/9 |
| 3,369,202 | 2/1968 | Gryctko | 335/9 |
| 3,414,850 | 12/1968 | Cooper | 337/47 |
| 3,422,381 | 1/1969 | Toth | 335/9 |

*Primary Examiner*—Harold Broome

*Attorney, Agent, or Firm*—Robert A. Cahill; Walter C. Bernkopf; Philip L. Schlamp

[57] ABSTRACT

A compact three-pole circuit breaker is modularly constructed utilizing two identical operating mechanisms in controllably articulating three movable contact arms. The operating mechanisms are ganged together for concerted manual operation by an external handle tie and internal means intercoupling the three movable contact arms and the operating mechanisms. Trip units, one in each breaker pole, independently act on an internal common trip bar to simultaneously trip the two operating mechanisms and thereby effect concerted opening movement of the contact arms in quick break fashion under the urgence of mechanism springs and assisting helper springs.

12 Claims, 8 Drawing Figures

COMPACT THREE-POLE CIRCUIT BREAKER

BACKGROUND OF THE INVENTION

The present invention relates to a three-pole, molded case circuit breaker of modular construction and compact physical size.

Heretofore, typical circuit protection for three phase electrical distribution circuits utilized in light industrial, commercial and institutional applications has been provided by three-pole molded case circuit breakers of the wire-in, wire-out variety. These circuit breakers would normally be installed in circuit breaker load centers containing banks of single-pole, plug-in circuit breakers for branch circuit protection. Since the typical three-pole circuit breaker, in addition to being nonplug-in, is wider than the combined width of three single-pole branch breakers, special provisions must be made to physically mount the three-pole breaker within the load center. Thus, the load centers must be specially designed to the customer's specifications to accept specified numbers of three-pole and single-pole breakers. Typically, the electrical connections between the three-pole breaker and the branch breaker line buses are prewired by the manufacturer. Under these circumstances, the load center is relatively inflexible in terms of the applications it can accommodate. That is, if the customer's electrical requirements should change in the future, the existing load center may not be conducive to the changed requirements. This is particularly true if an additional three-pole breaker is required.

It is accordingly an object of the present invention to provide a three-pole circuit breaker of compact modular construction.

A further object is to provide a three-pole circuit breaker of the above character which requires no special mounting provisions for its installation in a standard plug-in circuit breaker load center.

Another object is to provide a three-pole circuit breaker of the above character which is comparable in width to the combined widths of three, standard single-pole branch circuit breakers.

Yet another object is to provide a three-pole circuit breaker of the above character which is equipped with line terminal stabs enabling the installation of the breaker in any load center space normally occupied by three side-by-side branch circuit breakers.

A still further object is to provide a three-pole circuit breaker of the above character having improved current carrying and current interrupting capacities.

An additional object of the present invention is to provide a three-pole circuit breaker of the above character which is efficient in design, inexpensive to manufacture and reliable in operation.

Other objects of the invention will in part be obvious and in part appear hereinafter.

SUMMARY OF THE INVENTION

In accordance with the present invention, there is provided a compact three-pole circuit breaker having a molded case of a width comparable to the combined widths of three single-pole branch circuit breakers and line terminal stabs situated to accommodate installation in a plug-in circuit breaker load center at any location normally occupied by three side-by-side branch breakers. The three-pole circuit breaker utilizes two identical operating mechanisms in controllably articulating a movable contact arm situated in each of three pole chambers provided in the breaker case. The two operating mechanisms occupy positions intermediate adjacent pole chambers and are ganged together for concerted manual operation by an external handle tie and internal coupling elements operatively interconnecting the three contact arms and the operating mechanisms. Trip units, one in each pole chamber, independently act on an internal common trip bar to simultaneously trip both operating mechanisms and thus effect concerted opening movement of the three contact arms in quick break fashion under the urgence of mechanism springs, supplemented by helper springs.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Like reference numerals refer to like parts throughout the several views of the drawings.

DETAILED DESCRIPTION

Figure 1:
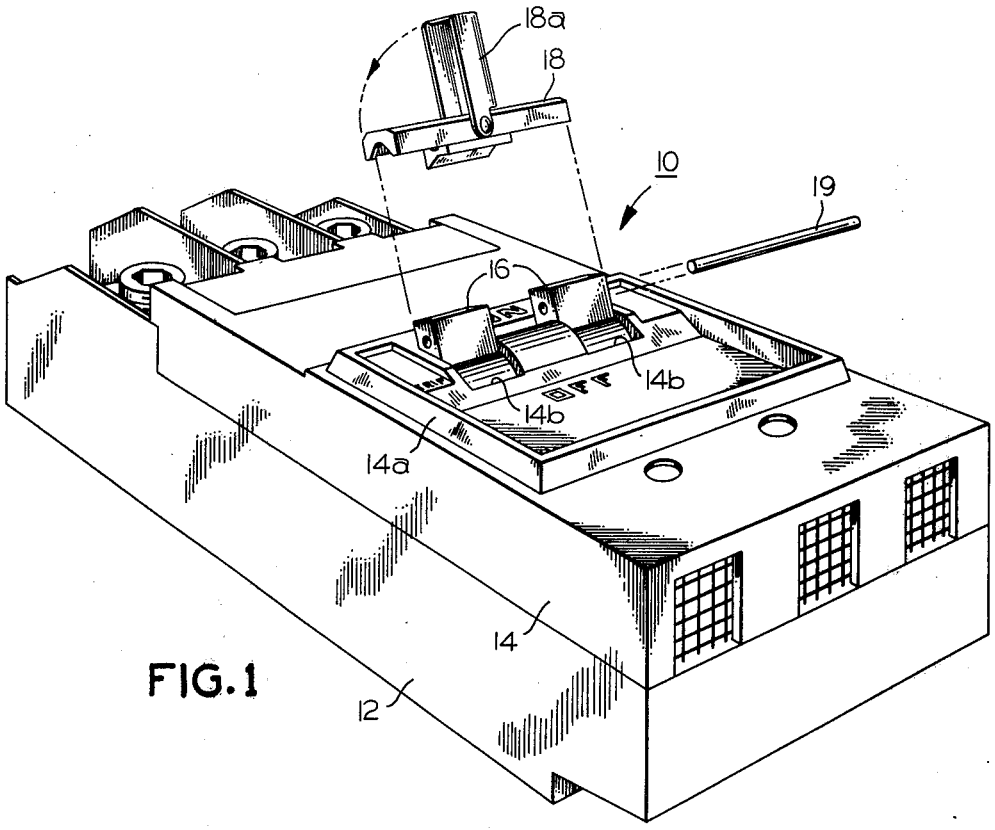
FIG. 1 is a perspective view of a three-pole, molded case circuit breaker constructed in accordance with the present invention.

Referring now to the drawings, the multi-pole circuit breaker of the present invention, generally indicated at 10 in FIG. 1, is housed in a molded insulative case consisting of a base 12 and a cover 14 secured together by screws, not shown. Top surface of cover 14 is provided with a raised escutcheon **14*a* in which are provided a pair of openings 14*b* accommodating the protrusion of a pair of manual operating handles 16. A handle tie 18, together with a pin 19, gangs the operating handles together such that they are pivoted in concert during manual operation of the circuit breaker. A lever 18*a*, pivotally mounted to handle tie 18**, may be swung upwardly and grasped by the operator to achieve enhanced mechanical advantage while toggling the operating handles.

Figure 2:
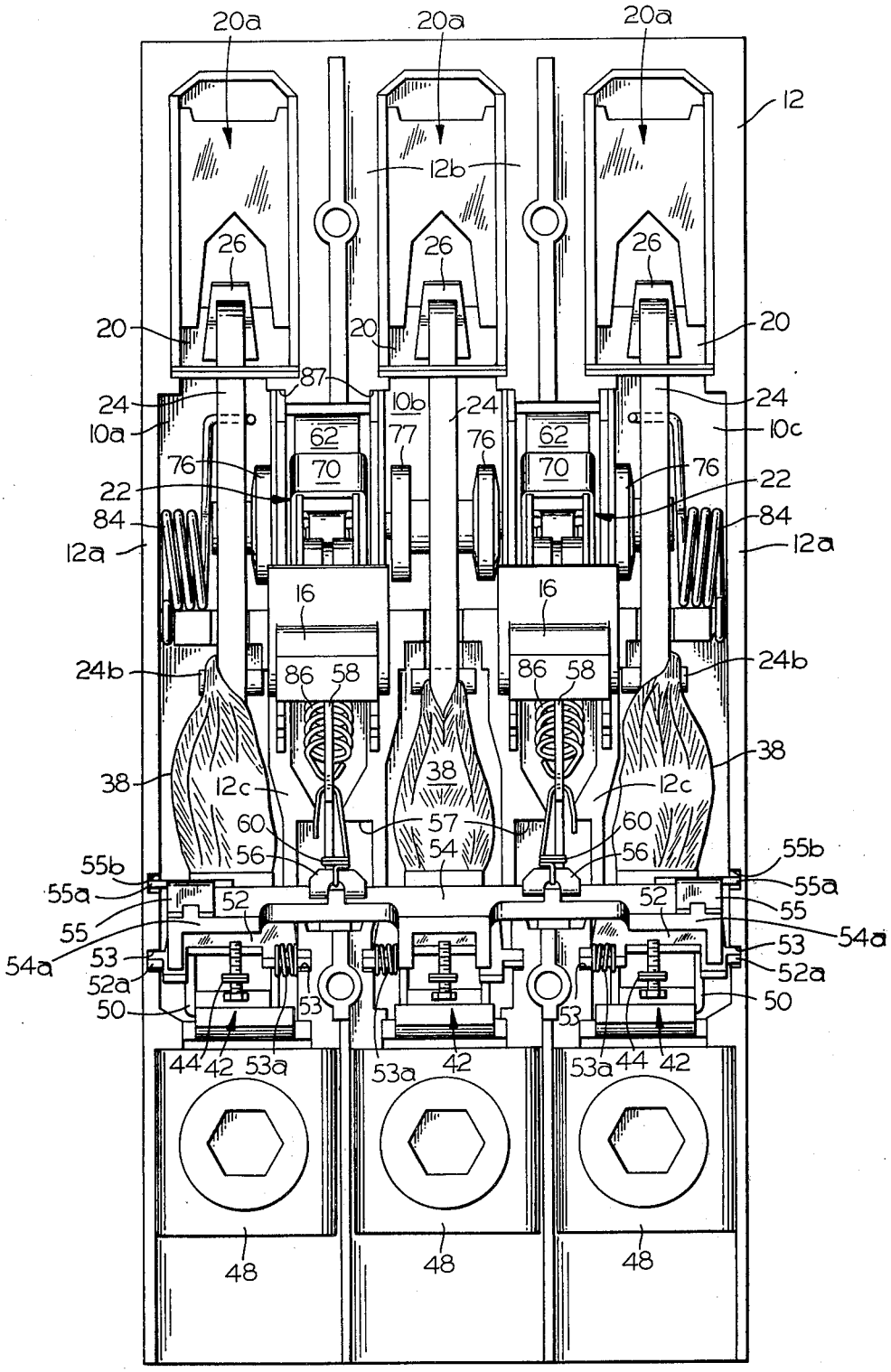
FIG. 2 is a plan view of the circuit breaker of FIG. 1 with the case cover removed.

Turning to FIG. 2, it is seen that base 12 of the breaker case is structured to provide three, side-by-side, longitudinally elongated pole chambers **10*a*, 10*b*** and 10c defined in part by base sidewalls 12a and intermediate, upstanding base partitions 12b and 12c. The intermediate partitions 12b, together with the base sidewalls provide arc chambers 20 at corresponding one ends of the three pole chambers; each arc chamber accommodating an arc chute, generally indicated at 20a. In the longitudinal gaps between partitions 12b and 12c, there is accommodated a pair of identical breaker operating mechanisms, each generally indicated at 22. It is seen that one of these operating mechanisms is positioned between left pole chamber 10a and center pole chamber 10b, while the other operating mechanism is positioned between center of pole chamber 10b and right pole chamber 10c. Operating in each breaker pole chamber is a movable contact arm 24 whose upper end (in the orientation seen in FIG. 2) extends into its associated arc chamber 20. A movable contact 26 is brazed to the upper end of each contact arm for movement therewith between open circuit and closed circuit positions with respect to an associated fixed or stationary contact situated in each arc chamber.

Figure 4:
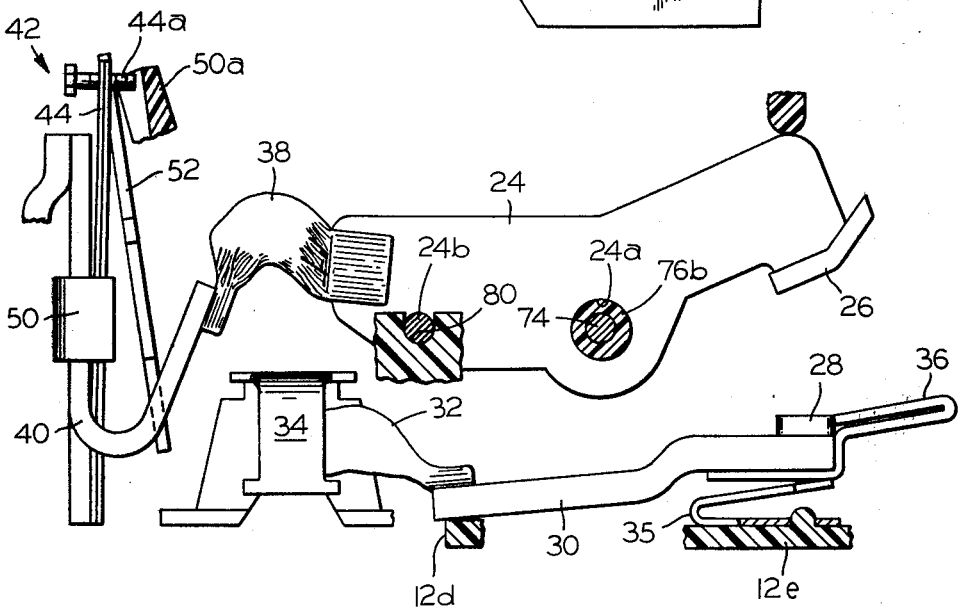
FIG. 4 is a side elevational view of the current path through each pole of the circuit breaker of FIG. 1.

Turning to FIG. 4, each fixed contact 28 is mounted atop one end of a separate line strap 30 whose other end is connected via a braid 32 to a female stab connector 34 exposed in an opening 12d provided in the floor 12e of breaker case 12. These female stab connectors accommodate male stab connectors of a plug-in circuit breaker load center pursuant to both electrically and physically installing circuit breaker 10 therein. These stab connectors, one situated in each breaker pole chamber, are positioned on, for example, one inch centers, thereby enabling circuit breaker 10, whose case is then three inches wide, to plug onto three consecutive, aligned load center stabs in the manner of three, side-by-side, one inch, single-pole branch circuit breakers.

Figure 3:
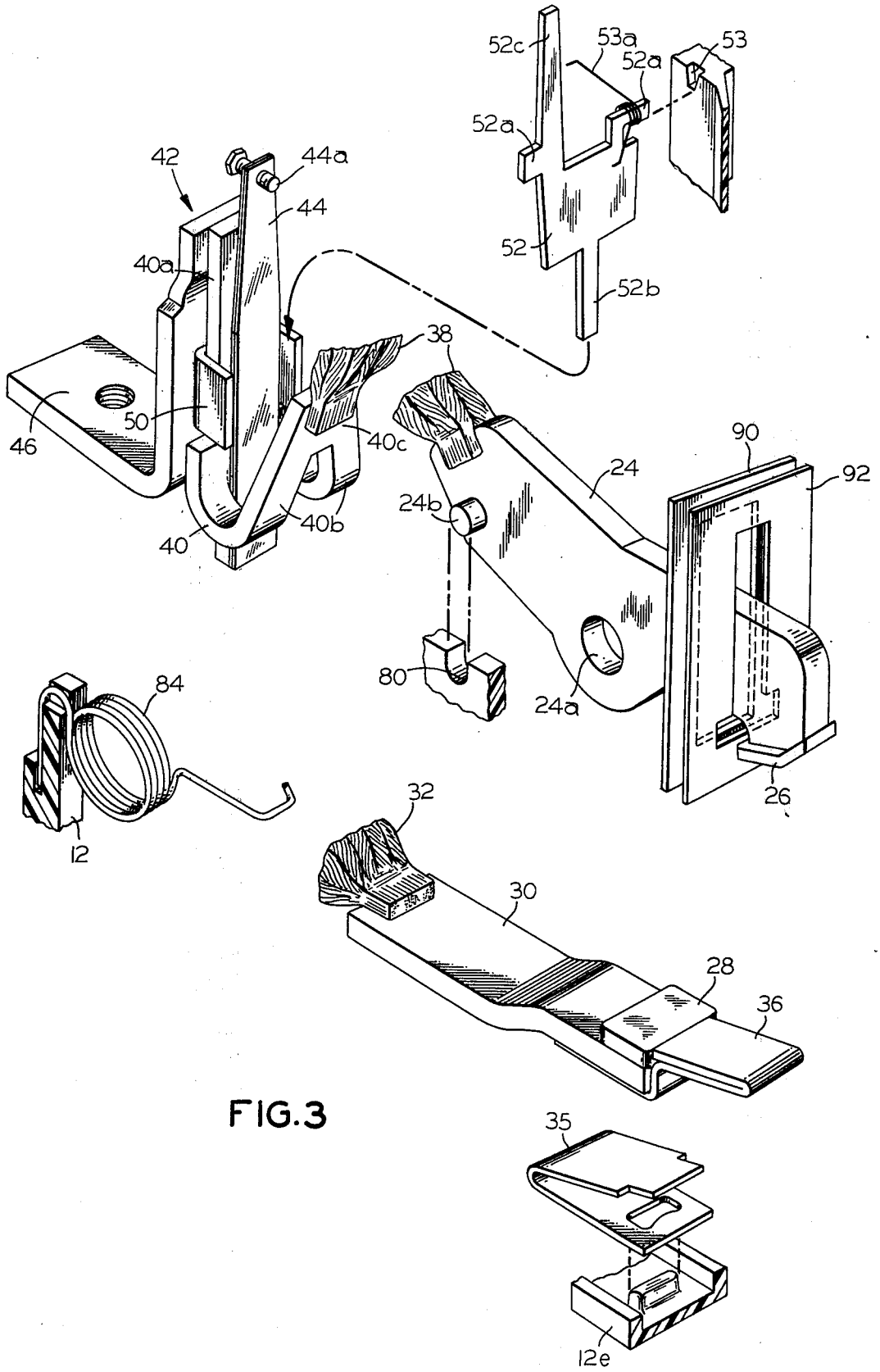
FIG. 3 is an exploded, perspective view of a portion of the current path through each pole of the circuit breaker of FIG. 1.
Figure 5:
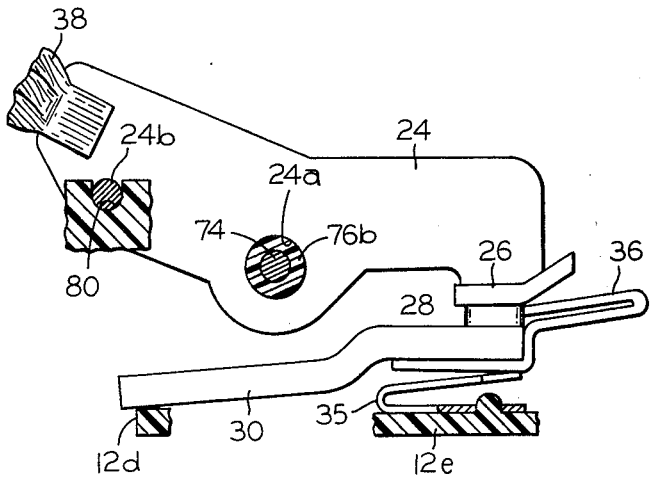
FIG. 5 is a fragmentary, side elevational view of a portion of the breaker pole current path seen in FIGS. 3 and 4, with the contacts engaged.

The fixed contact end of each load line strap 30, as seen in FIGS. 3–5, is resiliently supported with respect to floor 12e of the breaker case via an intervening hairpin spring 35. As seen in FIG. 5, with contact arms 24 in their closed circuit positions bringing the movable contacts 26 into electrical contacting engagement with their associated fixed contacts 28, springs 35 are compressed to supply upwardly directed spring forces effective in insuring adequate and uniform contact pressures. In addition, springs 35 serve to compensate for variations in the closed circuit positions of the contact arms 24 due to manufacturing tolerances. Also affixed to the fixed contact end of each line strap 30 is a steel arc runner 36 serving to direct an arc struck between the fixed and movable contacts during a circuit interruption out into the associated arc chutes 20a for efficient arc extinction. It will be noted that the upper surface of the arc runner is flush with the upper surface of fixed contact 28 so as to promote smooth running of an arc out onto the arc runner surface. The folded back configuration of the arc runners provides double thickness arc runner segments to withstand the eroding effects of successive circuit interruptions.

Referring jointly to FIGS. 2, 3 and 4, the end of each contact arm 24 remote from its movable contact end is electrically connected via a braid 38 to a heater 40 included in a separate trip unit, generally indicated at 42 and accommodated in each breaker pole chamber. Each heater is constructed as an integrally formed conductor having an upright body 40a from which extends a pair of laterally spaced, curved arms 40b terminating in a common path 40c to which the end of braid 38 is brazed. Welded to the lower terminal portion of upright heater body for vertical extension in proximate, thermally coupled relation thereto is a bi-metal 44. It will be noted that heater arms 40b straddle bi-metal 44 in accommodating its vertical extent, and together provide sufficient conductive metal cross-section in the stringent lateral confines of each pole chamber. Moreover, welding the braid 38 to the common termination of arms 40b rather than to the lower termination of heater body 40a at the location where bi-metal 44 is also welded obviates the need for specialized tri-metal welding techniques. The internal breaker circuit for each breaker pole is terminated by an L-shaped load strap 46, the vertical portion of which is welded at its upper termination to the upper terminal portion of its associated heater body 40a, while the horizontal load strap portion is bolted to the breaker case floor in electrical connection with a wire lug 48 seen in FIG. 2.

Each trip unit further includes a U-shaped magnetic field piece 50 mounted in partially embracing relation to heater body 40a. Flux developed in each field piece in response to current flowing through its associated heater body 40a acts on an associated armature 52 equipped with opposed laterally extending ears 52a received in opposed notches 53 formed in the rims of the case sidewalls 12a and intermediate partitions 12c, as the case may be, pursuant to pivotally mounting each armature in their respective pole chambers (FIG. 2). A torsion spring 53a provides the requisite armature bias in opposition to the magnetic attraction by its associated field piece 50, while a depending finger 52b engages an abutment (not shown) provided in the case 12 pursuant to establishing an appropriate air gap between the associated armatures and field pieces.

Figure 8:
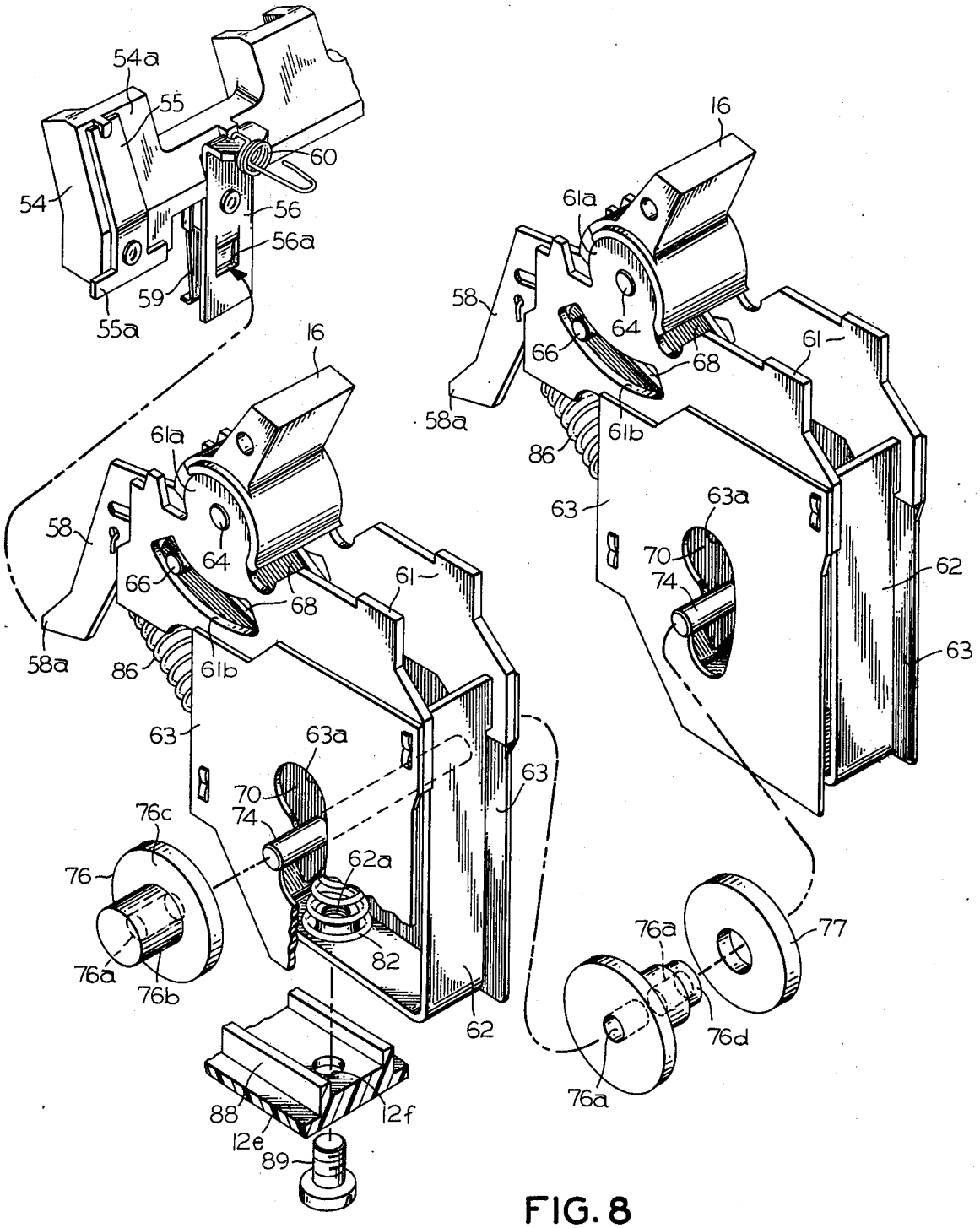
FIG. 8 is an exploded perspective view of a portion of the circuit breaker of FIG. 1, illustrating the internal coupling between the two breaker operating mechanisms.

To provide internal common tripping of the two breaker operating mechanisms 22 in response to an overcurrent condition in any one of the breaker poles, as sensed by the associated trip unit 42, there is provided a common trip bar 54 positioned to span the three pole chambers in proximate relation to each of the trip units. As best seen in FIGS. 2 and 8, a fitting 55 is riveted to each end of the trip bar to provide a laterally extending ear 55a which is received in opposed notches 55b formed in the rim of each case sidewall 12a pursuant to pivotally mounting the common trip bar. The common trip bar is further provided with a spaced array of upwardly extending protuberances 54a respectively situated above each pole chamber in confronting relation with the trip unit 42 therein. The common trip bar carries a pair of latch members 56 at locations intermediate adjacent pole chambers for dependence into cavities 57 provided in intermediate base partitions 12c. Each latch element is provided with a lanced latch shoulder 56a serving to latchably engage the tip 58a of a trigger 58 extending into the respective cavities 57 from the two operating mechanisms 22. Depending leaf springs 59 carried by the trip bar 54 act against an end wall in each intermediate partition cavity 57 to bias the trip bar into a pivotal position accommodating latching engagement of the latch shoulders 56a with the respective operating mechanism trigger 58 pursuant to releaseably detaining the two operating mechanisms in their reset or untripped conditions.

In the event of current of overload proportions flows through any one of the breaker poles, the bi-metal 44 of the trip unit 42 situated in that particular pole chamber is indirectly heated by the current flowing through the heater body 40a. The bi-metal 44 begins to flex, causing the tip of a calibrating screw 44a threaded through a tapped pole in the upper end thereof, to engage the confronting one of the protuberances 54*a*, causing trip bar 54 to pivot in a direction leading to the ultimate disengagement of the latch element shoulders 56*a* from the two operating mechanism triggers 58. As will be described below, upon unlatching of the operating mechanism triggers, they pivot downwardly away from the common trip bar to defeat internal operating mechanism latches pursuant to achieving circuit interruption in all three breaker poles in quick break fashion.

To effect magnetic tripping of the breaker in response to the flow of current of heavy overload and short circuit proportions through any one of the breaker poles, each armature 52 is provided with an upwardly extending finger 52*c* which is situated to engage the confronting one of the trip bar protuberances 54*a* as the armature is attracted to its actuated position by the flux generated in its associated field piece 50. This armature engagement induces pivotal movement of the trip bar in a direction to unlatch and trip both operating mechanisms 22. To prevent single phasing of one or two poles of breaker 10, the upper end of each latch element 56 is connected to the associated operating mechanism trigger 58 by a spring 60. Consequently, should one of the operating mechanism triggers unlatch before the other one, its tripping movement is communicated to common trip bar 54 via spring 60, thereby insuring pivotal movement of the common trip bar completely to its unlatching position well displaced from latching engagement with the other operating mechanism trigger. Thus, the possibility of one operating mechanism tripping without the other is precluded.

The two breaker operating mechanisms 22 are identical to each other and constructed essentially in the manner disclosed and claimed in commonly assigned U.S. Pat. No. 3,786,382, the disclosure of which is specifically incorporated herein by reference. As thus seen in FIGS. 6, 7 and 8, each operating mechanism includes a frame consisting of spaced metallic sideplates 61 rigidly interconnected by a J-shaped connecting member 62 via suitable means, such as staking. Also staked to the sides of the operating mechanism frame are insulative panels 63 which serve as interphase barriers for adjacent pole chambers. Along the upper edge of each frame sideplate there is provided a semi-circular projection 61*a* which serve to mount a transverse pin 64 on which operating handle 16 is pivotally mounted. Handle 16 is provided with a depending portion 16*a* which serves to carry a transverse pin 66 to which the upper ends of a pair of upper toggle links 68 are pivotally mounted. Frame sideplates are provided with arcuate slots 61*b* through which the ends of pin 66 move during pivotal manipulation of operating handle 16. Handle 16 is provided with a centrally located, longitudinally extending slot (not shown) for accommodating trigger 58 which is pivotally mounted by handle pin 64. The trigger is provided with an arcuate slot (not shown) so as to avoid interference with toggle pin 66.

Figure 6:
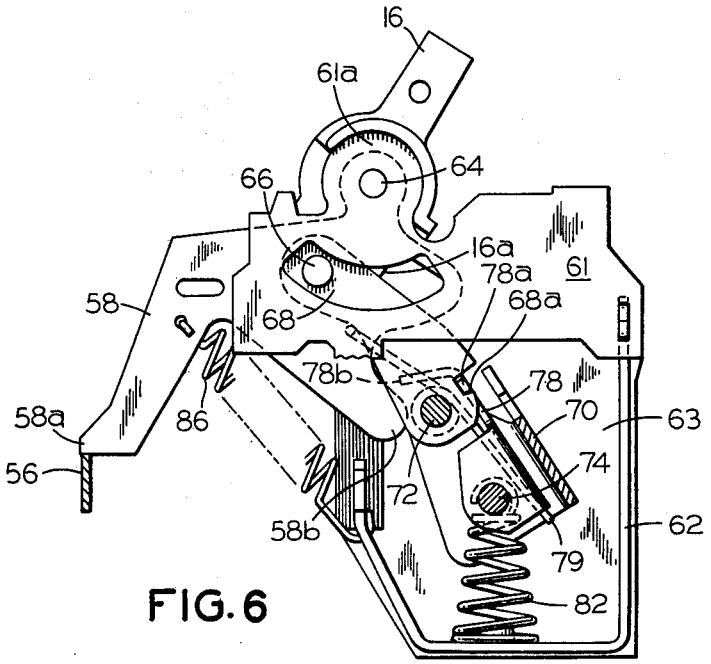
FIG. 6 is a side elevational view, partially broken away, of one of the breaker operating mechanisms utilized in the circuit breaker of FIG. 1, and depicted in its open circuit condition.
Figure 7:
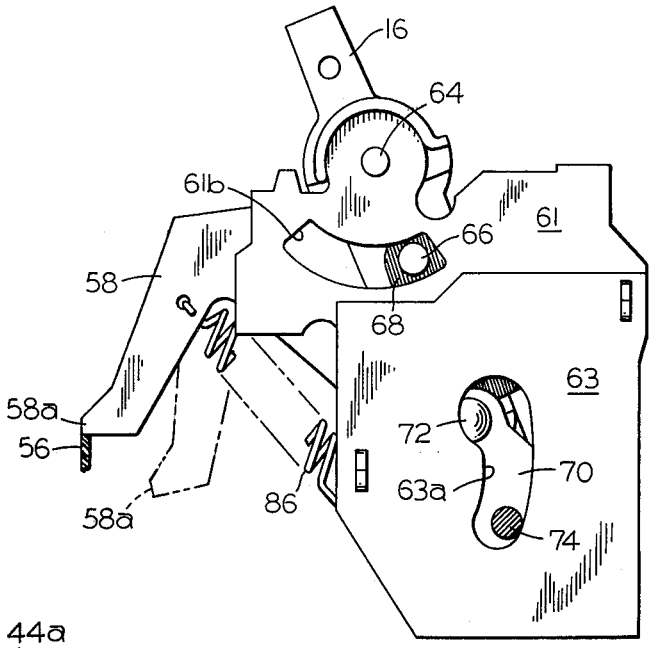
FIG. 7 is a side elevational view of the breaker operating mechanism seen in FIG. 6, but depicted in its closed circuit condition.

A lower toggle link 70, of U-shaped cross-section is pivotally connected to the two upper toggle links 68 by a knee pin 72 (FIG. 6). The lower end of toggle link 70 carries a transverse rod 74 which extends well beyond both sides of the mechanism frame through kidney-shaped slots 63*a* formed in the insulative panels 63. To insulatively, mechanically couple the movable contact arms 24 to the operating mechanisms 22, a grommet 76 of insulative material is provided with opposed, centrally located blind holes 76*a* into which the ends of rod 74 are inserted pursuant to mounting a separate grommet to each end of this rod. Each grommet is provided with a hub 76*b* which is received in a hole 24*a* provided in each movable contact arm 24, while an integral grommet flange 76*c* provides the requisite spacing between the operating mechanism frame and the contact arms to each side thereof. As best seen in FIG. 8, the grommet mounting the center pole contact arm accommodates the insertion from opposite sides of the rods 74 from the two operating mechanisms 22 into its blind central holes 76*a* to achieve effective ganging of the three movable contact arms. The grommet located intermediate the two operating mechanisms has an insulative washer 77 fitted on its step-down hub portion 76*d* so as to cooperate with the grommet flange 76*c* in centrally locating the center pole contact arm with respect to the two operating mechanisms.

As disclosed in greater detail in the above-noted U.S. Pat. No. 3,786,382, the operating mechanism toggle is normally maintained in an essentially straightened condition whereby pivotal movement of the operating handle 16 is communicated to the movable contact arms 24 pursuant to articulating them between their open and closed circuit positions. However, when the operating mechanisms are tripped by the action of any one of trip units 42 is releasing triggers 58, the ability of the toggle in each operating mechanism to maintain its straightened condition is defeated, enabling the movable contact arms to jointly move to their open circuit positions independently of the operating handles. To this end, as seen in FIG. 6 herein, a latch 78 is pivotally mounted adjacent its lower end on rod 74 and carries adjacent its upper end laterally extending ears 78*a* which are adapted to engage latch shoulders 68*a* formed adjacent the lower ends of the two upper toggle links 68. A torsion spring 79 carried on knee pin 72 acts on latch 78 to normally bias it in a counterclockwise pivotal direction seen in FIG. 6, thereby urging the latch ears 78*a* into positions of latching engagement with their associated latch shoulders 68*a*. It is thus seen that, as long as this latching engagement is maintained, relevant pivotal movement of the two toggle links about their knee pin 72 is restrained, and the toggle is thus maintained in its illustrated substantially straightened condition. Under these circumstances, with pivotal movement of handles 16 in the counterclockwise direction from their positions in FIG. 6 to their positions seen in FIG. 7, the movable contact arms 24 ganged to rods 74 are jointly rocked downwardly, generally about pins 24*b* extending from each side of each contact arm and caught in opposed notches 80 formed in interior portions of base 12 located in each pole chamber. When, during this downward movement of the contact arms 24 their movable contact 26 engage their associated stationary contacts 28, the fulcrums for the rocking motion of the contact arms shift to the point of contact engagement, and the opposite ends of the contact arms move downwardly, ducking pins 24*b* toward the bottoms of notches 80 at the conclusion of contact closure articulation of the operating mechanisms. During downward movement of the contact arms leading to circuit breaker closure, a compression spring 82 located in each operating mechanism and acting between J-shaped frame member 62 and rods 74 is loaded preparatory to powering an opening movement of the operating mechanisms and contact arms in quick break fashion. Also serving in this capacity are outboard helper springs 84, seen in FIGS. 2 and 3, having their one ends hooked on portions of base 12 and their other ends hooked on the left and right pole movable contact arms. To manually open circuit breaker 10, the handles are toggled in the clockwise direction back to the position of FIG. 6, thereby lifting the straightened toggle and the contact arms are rocked upwardly to open circuit positions under the urgence of springs 82, 84.

To defeat the restraint maintaining the toggle in its straightened condition, latch 78 is provided with an upwardly extending tab **78*b* which is poised in a position to be struck by a nose 58*b* carried by trigger 58 when the latter is released from latch shoulder 56*a* pursuant to tripping the operating mechanisms 22. Tripping movement of triggers 58 is powered by individual springs 86 connected between each trigger and its associated mechanism frame member 62. It is seen from FIG. 6 that upon unlatching of the triggers, springs 86 propel their triggers in a counterclockwise direction bringing the trigger nose 58*b* into striking engagement with latch tab 78*b*, causing latch ears 78*a* to disengage latch shoulders 68*a*. The toggle of each operating mechanism is thus freed to buckle under the urgence of springs 82 and 84, and the contact arms 24 are abruptly rocked upwardly to their open circuit positions, all as more clearly disclosed in the above-noted patent. With the operating mechanisms tripped, a handle spring (not shown) biases the two operating handles 16 to an intermediate, trip indicating position. To reset the operating mechanisms, the operating handles are pivoted to their clockwisemost positions seen in FIG. 6, lifting their triggers 58 upwardly into positions of latching engagement with their respective latch shoulders 56*a* and, at the same time, straightening the toggle to bring the latch ears 78*a* back into latching engagement with latch shoulders 68*a***. With the toggle now held in its straightened condition, the breaker can be reclosed.

It will be noted that each operating mechanism 22 is operatively positioned independently of cover 14 by various grooves 87 (FIG. 2) and ridges 88 (FIG. 8) formed in portions of base 12, and secured by a screw 89 extending through a hole **12*f* in base floor 12*e* and threaded into a tapped bore 62*a* provided in swagged-up portion of frame member 62. This swagged-up portion serves to positionally locate the lower end of mechanism spring 82. By virtue of this construction, together with the pivotal mounting of the armatures 52 and common trip bar 54 in the base 12, it is seen that circuit breaker 10 is operational with cover 14** removed to facilitate trouble shooting.

As an additional feature of the present invention, the ends of the contact arms 24 extend into their respective arc chambers 20 through vertically elongated slots provided in a pair of barriers 90 and 92, seen in FIGS. 2 and 3. Barriers 92, closest to the arc chambers are formed of bone fiber which ablate water vapor in the presence of arcing; this water vapor assisting in moving the arcs out into the arc chutes **20*a*. The other barriers 90 are formed of a rigid, high temperature melamine and are engaged along their upper edges by the cover to press down on the load straps 30 situated therebeneath to preset the open circuit positions of the stationary contacts 28 and the initial loading of springs 35 (FIGS. 4 and 5**).

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. An electric circuit breaker comprising, in combination:

A. an insulative case consisting of a base and a cover,
(1) said base including opposed sidewalls and two intermediate partitions serving to define longitudinally elongated, side-by-side right, center and left pole chambers;

B. a movable contact arm situated in each said pole chamber, each said arm mounting a movable contact at one end;

C. a pair of operating mechanisms respectively positionally mounted in laterally aligned interruptions provided in said intermediate partitions to locate one of said operating mechanisms between said right and center pole chambers and the other between said left and center pole chambers, each said operating mechanism including
(1) a frame, (2) a manual operating handle pivotally mounted by said frame and protruding through an opening in said cover, (3) a toggle consisting of upper and lower links pivotally interconnected by a knee pin, said upper link pivotally connected to said handle,
(4) a rod carried by said lower toggle link for transverse extension into the pole chambers to each side of said operating mechanism.
(5) a spring acting between said rod and said frame in a direction to collapse said toggle, and
(6) a trigger normally, releaseably retained in a reset position and, upon release, moves to a tripped position effecting collapse of said toggle under the urgence of said spring;

D. a separate trip unit situated in each said pole chamber for monitoring the current flowing therethrough, E. a common trip bar extending transversely through said pole chambers in actuatable relation with each said trip unit, said trip bar carrying a pair of latch members for individually, releaseably retaining said trigger of each said operating mechanism in its reset condition, whereby the response of any one of said trip units to an overcurrent condition actuates said common trip bar to commonly release said triggers for individual movement to their tripped positions;

F. separate right, center and left pole insulative grommets having central bores for acceptance therein of the ends of said operating mechanism rods extending into said right and left pole chambers, and a hub for receipt in a hole formed in said movable contact arms situated in said left and right pole chambers, said center pole grommet having oppositely directed, blind central bores aligned for acceptance of the ends of the rods of the two operating mechanisms extending from opposite directions into said center pole chamber and a hub for receipt in a hole formed in said contact arm therein, thereby commonly interconnecting the two operating mechanisms and said contact arms; and G. an external handle tie interconnecting the operating handles of said operating mechanisms.

2. The circuit breaker defined in claim 1, wherein said right and left pole grommets each include an annular flange for spacing said contact arms in said right and left pole chambers from said operating mechanisms, and said center pole grommet includes a pair of annular flanges straddling said contact arm in said center pole chamber for spacing said center pole chamber contact arm from both said operating mechanisms.

3. The circuit breaker defined in claim 1, wherein said operating mechanism frames are bolted to said base.

4. The circuit breaker defined in claim 1, which further includes helper springs acting on said contact arms in said left and right pole chambers in assistance to said operating mechanism springs.

5. The circuit breaker defined in claim 1, which further includes tension springs interconnecting said triggers with said trip bar, whereby the movement of one of said triggers toward its tripped position acts on said trip bar via its associated tension spring to insure release of the other one of said triggers.

6. The circuit breaker defined in claim 1, which further includes a line stab connector situated in each said pole chamber intermediate its longitudinal ends, a line strap situated in each said pole chamber, each said line strap electrically connected at one end to said line stab connector in its pole chamber and carrying a stationary contact adjacent its other end, and a separate compression spring situated between a bottom surface of each said pole chamber and the stationary contact end of the line strap therein.

7. The circuit breaker defined in claim 6, which further includes an arc chute situated in one longitudinal end of each said pole chamber, and an arc runner affixed to the stationary contact end of each said line strap for extension into proximity with an associated one of said arc chutes, each said arc runner consisting of a metallic strip bent back on itself to provide a double thickness portion extending between its associated stationary contact and arc chute, the upper surface of said double thickness portion being flush with the upper surface of its associated stationary contact.

8. The circuit breaker defined in claim 7, which further includes a pair of side-by-side barriers transversely situated in each said pole chamber, each said barrier pair having vertically elongated slots through which the associated movable contact arm extends to present its movable contact for engagement with the associated one of said stationary contacts, the one barrier of each pair nearest the associated one of said arc chutes composed of bone fiber and the other barrier composed of a rigid, high temperature melamine, said other barrier engaging said associated line strap along its lower edge and engaged along its upper edge by said cover to provide a predetermined preloading of the associated one of said compression spring.

9. The circuit breaker defined in claim 8, wherein said right and left pole grommets each include an annular flange for spacing said contact arms in said right and left pole chambers from said operating mechanisms and said center pole grommet includes a pair of annular flanges straddling said contact arm in said center pole chamber for spacing said center pole chamber contact arm from both said operating mechanisms.

10. The circuit breaker defined in claim 9, wherein said operating mechanism frames are bolted to said base.

11. The circuit breaker defined in claim 10, which further includes helper springs acting on said contact arms in said left and right pole chambers in assistance to said operating mechanism springs.

12. The circuit breaker defined in claim 11, which further includes tension springs interconnecting said triggers with said trip bar, whereby the movement of one of said triggers toward its tripped position acts on said trip bar via its associated tension spring to insure release of the other one of said triggers.

* * * * *